US005622067A

United States Patent [19]

Waitz

[11] Patent Number: 5,622,067

[45] Date of Patent: Apr. 22, 1997

[54] USER-CODABLE MAGNETIC LOCK

[75] Inventor: Karl-Heinz Waitz, Iserlohn, Germany

[73] Assignee: Sudhaus Schloss-und Beschlagtechnik GmbH & Co., Iserlohn, Germany

[21] Appl. No.: 377,923

[22] Filed: Jan. 25, 1995

[30] Foreign Application Priority Data

Jan. 27, 1994 [DE] Germany ..... 44 02 349.9

[51] Int. Cl.[6] ..... E05B 47/00

[52] U.S. Cl. ..... 70/276; 70/413; 70/284; 70/411

[58] Field of Search ..... 70/276, 278, 284, 70/285, 413, 411, 315, 312, 365

[56] References Cited

U.S. PATENT DOCUMENTS

| | | | |
|---|---|---|---|
| 3,633,393 | 1/1972 | Hisatsune | 70/276 |
| 3,657,907 | 4/1972 | Boving | 70/276 X |
| 3,797,288 | 3/1974 | Hallmann | 70/276 |
| 3,863,469 | 2/1975 | Atkinson | 70/74 |
| 3,955,388 | 5/1976 | Stackhouse | 70/411 |
| 4,084,416 | 4/1978 | Prunbauer | 70/276 |
| 4,253,320 | 3/1981 | Schwab et al. | 70/365 X |
| 4,324,120 | 4/1982 | Gisiger | 70/312 |
| 4,557,122 | 12/1985 | Hwang | 70/284 X |
| 4,665,726 | 5/1987 | Prunbauer et al. | 70/276 |
| 4,669,284 | 6/1987 | Prunbuaer et al. | 70/276 |
| 4,938,044 | 7/1990 | Chang | 70/315 |
| 5,072,604 | 12/1991 | Eisermann | 70/276 |
| 5,359,867 | 11/1994 | Ling et al. | 70/312 X |
| 5,406,815 | 4/1995 | Sedley | 70/276 |

FOREIGN PATENT DOCUMENTS

| | | | |
|---|---|---|---|
| 349355 | 8/1978 | Austria . | |
| 2249228 | 5/1975 | France | 70/413 |
| 2346529 | 10/1977 | France . | |
| 2507599 | 9/1976 | Germany | 70/276 |
| 2952770 | 3/1981 | Germany | 70/276 |
| 3230633 | 2/1984 | Germany | 70/276 |
| 4107076 | 10/1992 | Germany . | |
| 84100876 | 8/1992 | Japan . | |
| 1769774 | 10/1992 | Russian Federation . | |
| WO92/06264 | 4/1992 | WIPO . | |

*Primary Examiner*—Suzanne L. Dino
*Attorney, Agent, or Firm*—Herbert Dubno; Andrew Wilford

[57] ABSTRACT

A magnetically coded lock assembly has a lock having a housing formed with a key slot, a latch element movable in the housing between a locked and an unlocked position, and at least one magnet wheel in the housing rotatable adjacent the slot about a wheel axis. This magnet wheel is provided with a magnet, operatively engageable with the latch element, and displaceable between a blocking position preventing the latch element from moving from the locked to the unlocked position and a freeing position not blocking such movement of the latch element. A key has a body fittable in the slot and formed with at least one seat and a respective magnet-carrying disk rotatable in the seat about a disk axis through a plurality of angularly offset positions. Each disk is closely juxtaposed with a respective one of the wheels when the key body is fitted in the slot.

11 Claims, 10 Drawing Sheets

USER-CODABLE MAGNETIC LOCK

FIELD OF THE INVENTION

The present invention relates to a lock. More particularly this invention concerns a lock which is coded magnetically and that is operated by a magnetic key.

BACKGROUND OF THE INVENTION

A standard magnetically coded lock has a lock housing in which a latch element can slide between a locked position and an unlocked position. In the locked position the mechanism holds the drawer, door, safety-deposit box, or the like closed, while in the unlocked position it can be opened. The lock typically has a plurality of movable wheels or elements that carry magnets that can coact with magnets on a key to move into a position permitting the latch element to move into the unlocked position. Thus when the key is inserted into the lock, the magnetic elements in the lock are moved by the magnets on the key into an aligned position permitting the lock to be opened.

While such an arrangement can provide a high degree of security it has the substantial disadvantage that the coding of the lock and key are set at the factory and are not readily changeable by the end user. Thus if a key is lost, a new one must be obtained from the manufacturer. In addition it is impossible or extraordinarily difficult for the end user of the lock to change the combination or coding.

OBJECTS OF THE INVENTION

It is therefore an object of the present invention to provide an improved magnetically coded lock.

Another object is the provision of such an improved magnetically coded lock which overcomes the above-given disadvantages, that is whose combination can be set and reset by the user.

SUMMARY OF THE INVENTION

A magnetically coded lock assembly has according to the invention a lock having a housing formed with a key slot, a latch element movable in the housing between a locked and an unlocked position, and at least one magnet wheel in the housing rotatable adjacent the slot about a wheel axis. This magnet wheel is provided with a magnet, operatively engageable with the latch element, and displaceable between a blocking position preventing the latch element from moving from the locked to the unlocked position and a freeing position not blocking such movement of the latch element. A key has a body fittable in the slot and formed with at least one seat and a respective magnet-carrying disk rotatable in the seat about a disk axis through a plurality of angularly offset positions. Each disk is closely juxtaposed with a respective one of the wheels when the key body is fitted in the slot.

With this system, therefore, it is possible to change the setting of the key. A new key coding can easily be created just by rotating the disks of the key to the appropriate positions. So long as the coding of the lock is known, it is very easy to create new keys for it.

The key body according to the invention is made of plastic and is formed with seats for the key disks. In addition the key disks and wheels are rotatable about respective disk and wheel axes and the respective magnets are mounted eccentrically relative to the respective axes.

Furthermore in accordance with this invention a retaining spring in the lock housing engages the latch element and is movable between a blocking position projecting into the slot and preventing movement of the latch element from either of its positions and a depressed position not projecting into the slot and permitting movement of the latch element between its positions. The key body is dimensioned to engage the retaining spring to depress same into the depressed position on insertion of the key fully into the slot. Thus the latch element cannot move at all from either of its end positions unless a key is inserted fully into the slot and the inserted key has the right coding. When this retaining spring is in the back of the slot it also serves to eject the key from the slot when the locking or unlocking operation is complete.

According to a further feature of the invention an actuating spring in the lock housing engaging the latch element has an actuation portion displaceable between a projecting position projecting into the key slot with the actuating spring urging the latch element into the locked position and a depressed position not projecting into the slot with the actuating spring urging the latch element into the unlocked position. The key body has generally parallel lock and unlock edges and an end bridging the edges and formed with a projection and a cutout. The key body is dimensioned such that when inserted fully into the slot with its unlock edge first the projection engages the actuation portion and displaces same into the depressed position and when inserted fully into the slot with its lock edge first the notch engages over the actuation portion and leaves same in the projecting position. Thus with this system the key is inserted unlock edge first to unlock the lock, and is reversed and reinserted to lock it. This prevents errors while remaining a very simple system.

To allow the lock coding also to be set by the end user each magnet wheel is rotatable about a respective axis and is provided with a coupling wheel also rotatable about the respective axis and engageable with the latch element. Each magnet wheel and the respective coupling wheel have confronting faces one of which is formed with an annular array of recesses and the other of which is formed with at least one coupling projection engageable in the recesses in any of a plurality of relatively angularly offset positions of the respective magnet wheel and coupling wheel. The assembly further has, according to this feature of the invention, means for axially separating the magnet wheels from the respective coupling wheels so that when the wheels are separated the relative angular positions which determine a coding of the lock can be changed. A spring urges the coupling wheels toward the respective magnet wheels. The separating means includes a slide in the lock housing having ramps engageable with the coupling wheels and displaceable between a normal position generally out of engagement with the coupling wheels and a reset position engaging the coupling wheels and lifting same off the respective magnet wheels. Thus it is possible to move the slide into the reset position and insert a key into the slot to reset the magnet wheels to the coding of the key. This allows the end user to set any desired coding in the key and lock, and allows the manufacturer to provide the locks all with a standardized coding that is changed by the end user, greatly reducing stocking and manufacturing complexities.

In another system according to the invention each wheel comprises a lower wheel carrying the magnet and formed with a lower cutout and an upper wheel rotationally and axially coupled to the lower wheel and formed with an upper cutout angularly offset from the respective lower cutout. Each upper and lower wheel is axially displaceable between a lower position with the upper cutout aligned with the latch member and an upper position with the lower cutout aligned with the latch member. The latch member is formed with bumps engageable in the respective cutouts aligned with the latch member in the freeing position of the wheels. The magnets of the key attract the magnets of the wheels and hold same in the lower position when the key is inserted into the slot. A second key like the first key has oppositely polarized magnets that repulse the magnets of the wheels and hold same in the upper position when the second key is inserted into the slot. Thus two different keys can actuate the same lock.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
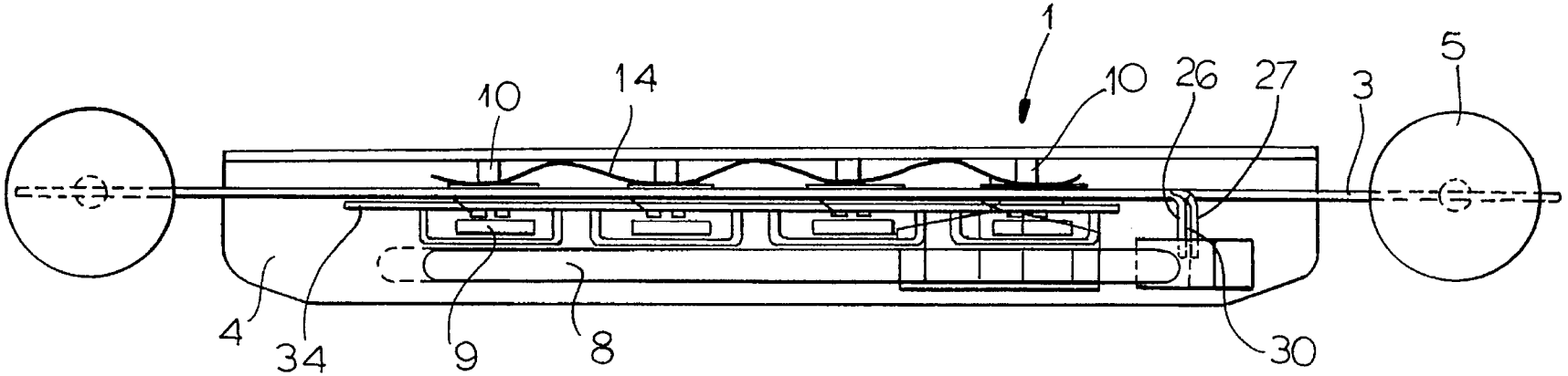
FIG. 1 is a top view of the lock according to the invention with some parts removed for clarity of view.
Figure 2:
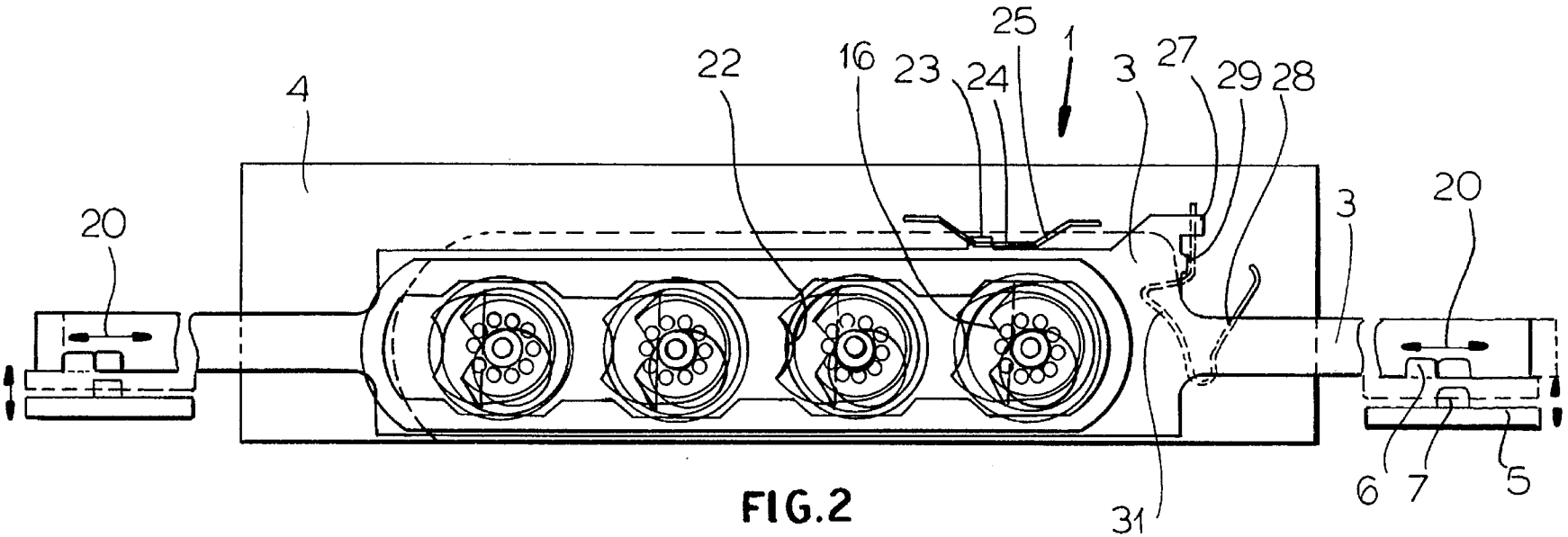
FIG. 2 is a side view of the lock of FIG. 1.

As seen in FIGS. 1 and 2 a lock 1 according to this invention has a plastic housing 4 that is set in the edge of a door, drawer, safety-deposit box, or the like, and that is provided with a latch element formed as a thin elongated metal plate 3 that has ends projecting from the housing 4 and that is movable longitudinally parallel to its plane as shown by arrows 20. The projecting ends of the plate 3 are formed with laterally open notches 6 into which can fit bumps 7 of opening buttons 5. Only when the notches 6 and bumps 7 are aligned can the buttons 5 be depressed to open the door or drawer in which the lock 1 is mounted. The side of the lock housing 4 is formed with an elongated key slot 8 into which a key 2 shown in FIGS. 25 and 26 can fit.

Figure 11:
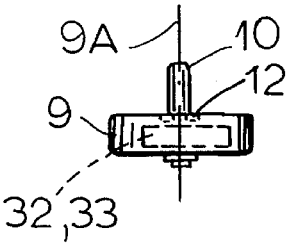
FIGS. 11 and 12 are side and top views of a lock wheel.
Figure 12:
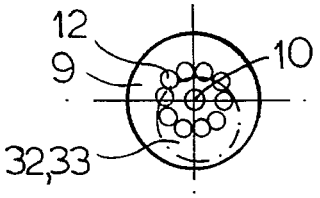

Inside the housing 4 are four lock wheels 9 having pivots or axles 10 defining axes 9A (FIG. 11) which are coplanar, parallel to each other, and perpendicular to the plane of the latch plate 3. As better shown in FIGS. 11 and 12 each wheel 9 is formed centered on the respective axis 9A with an array of ten angularly equispaced and upwardly open holes or recesses 12 all equidistant from the axis 9A. Each wheel 9 is also formed offset from the axis 9A with a downwardly open cavity 32 in which is glued a respective permanent magnet 33 that is polarized parallel to the respective axis 9A.

Figure 3:
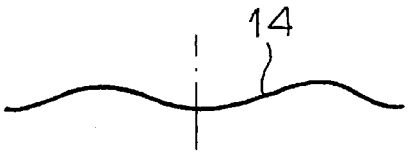
FIGS. 3 and 4 are side and top views of part of a spring of the lock.
Figure 4:
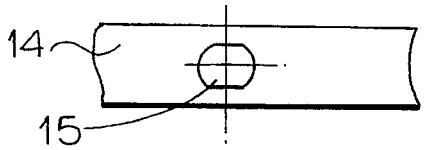

Each lock wheel 9 is associated with a respective coupling disk 11 that is pivotal on the respective axle 10 and that is formed with a plurality of downward projections 13 that can fit into the holes 12 of the respective wheel 9 in any of ten angularly offset relative positions. A leaf spring 14 (FIGS. 3 and 4) is formed with holes 15 through which the axle pins 10 pass and is of sinusoidal shape. It is braced between the housing 4 and the coupling wheels 11 to push same down onto the lock wheels 9, with the four coupling pins 13 on the wheels 11 engaging in four of the holes 12 on the wheels 9 to rotationally couple each wheel 9 to the respective wheel 11 in, as mentioned above, any of ten different relative angular positions.

Figure 5:
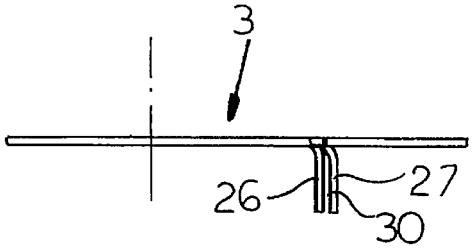
FIGS. 5 and 6 are side and top views of part of a latch element of the lock.
Figure 6:
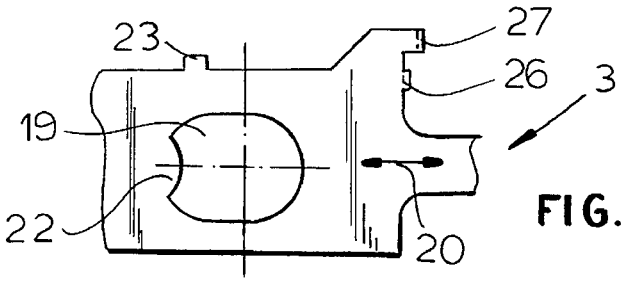
Figure 8:
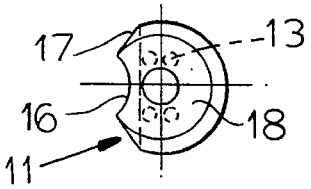

The plate 3 as shown in FIGS. 5 and 6 is formed with four apertures 19 that are elongated in the movement direction 20 and that are aligned over the wheels 9 and 11, with in fact raised central portions 18 of the wheels 11 projecting up through these apertures 19. The wheels 11 are each formed with a radially outwardly open circular cutout 16 and the holes 12 are formed with complementary inwardly directed bumps 22. The spacing between each bump 22 and the opposite side of the respective aperture 19 is about equal to the diameter of the portion 18 of the respective wheel 11 projecting through this aperture 19, so that the plate 3 can only move in the direction 20 when the notch 16 is radially directly aligned with the bump 22 and, therefore, the bump 22 can fit into the notch 16. If any of the wheels 11 is in a position with its notch 16 not directly aligned with the respective bump 22, the plate 3 is blocked against moving in the direction 20.

Figure 7:
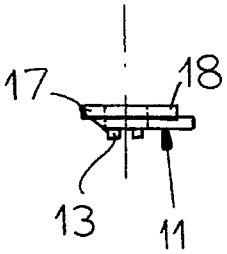
FIGS. 7 and 8 are side and top views of a coupling wheel of the lock.
Figure 9:
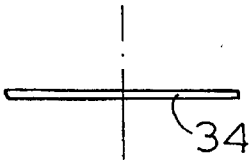
FIGS. 9 and 10 are side and top views of part of a coding slide of the lock.
Figure 10:
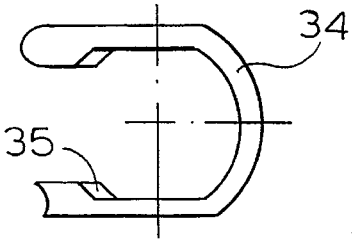
Figure 15:
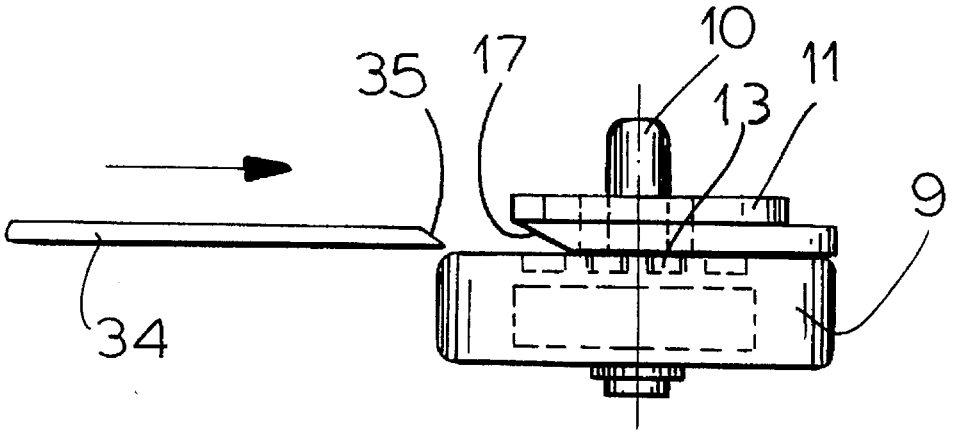
FIGS. 15 and 16 are side views of a portion of the lock in the normal and reset positions, respectively.
Figure 16:
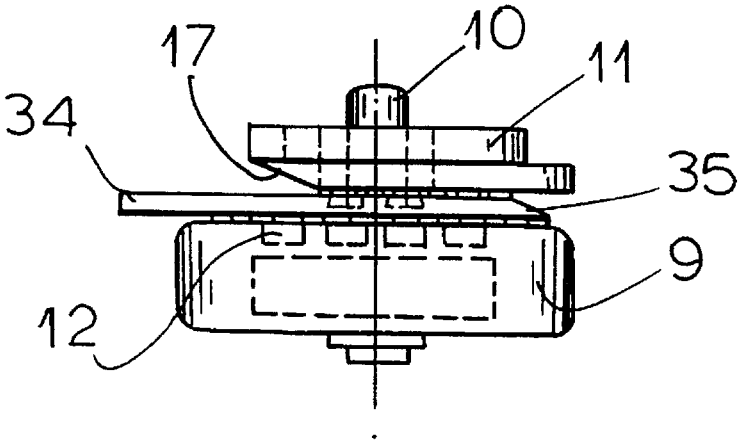
Figure 17:
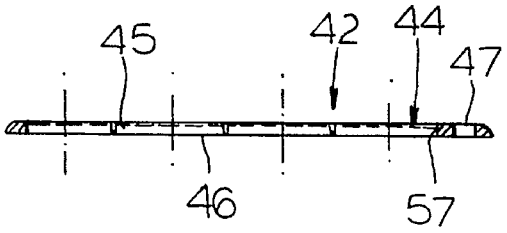
FIGS. 17 and 18 are side and top views of the top part of the key body.
Figure 19:
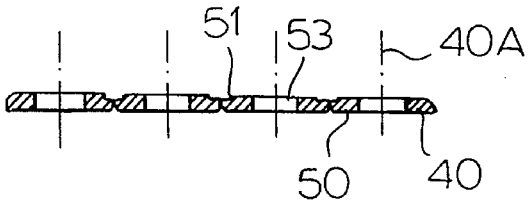
FIGS. 19 and 20 are side and top views of the key disks.
Figure 21:
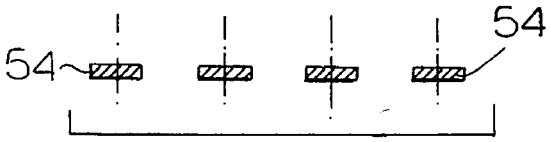
FIGS. 21 and 22 are side and top views of the key magnets.
Figure 23:
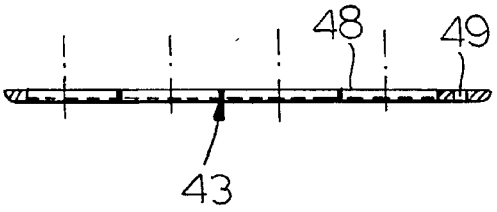
FIGS. 23 and 24 are side and top views of the bottom part of the key body.
Figure 27:
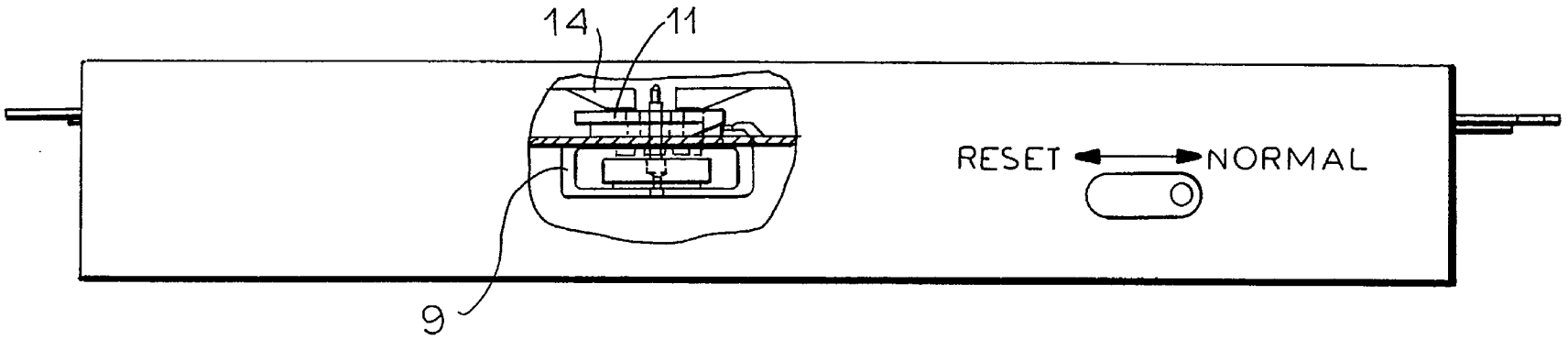
FIGS. 27 and 28 are side and partly sectional views illustrating the lock in the normal and reset positions, respectively.
Figure 28:
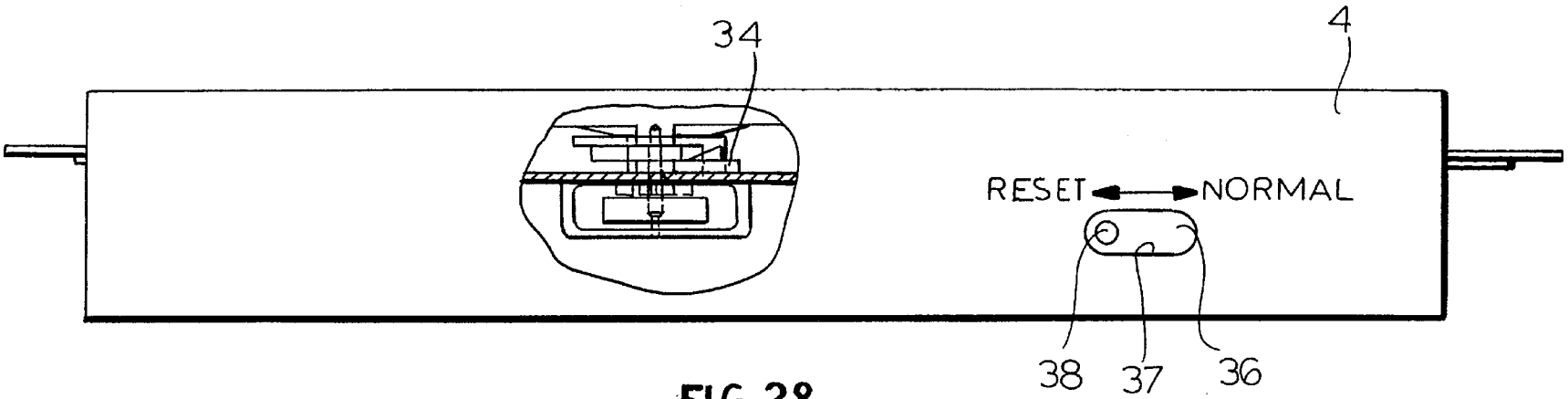

As best seen in FIG. 7 each wheel 11 is formed on its lower side to the side of the axis 9A of the notch 16 with a bevel or ramp 17. A coding slide 34 shown in FIGS. 9 and 10 is formed as a flat metal plate lying directly underneath the plate 3 and has for each wheel 11 a wedge or ramp formation 35 that can engage under the ramp 17 of the respective wheel 11 to cam same axially upward against the force of the spring 14 into a position with the coupling pins 13 pulled out of the holes 12. This is shown in FIGS. 15 and 27 where the slide 34 is shown in the normal position and in FIGS. 16 and 28 in a reset position. As shown in FIGS. 27 and 28 the housing 4 is formed with a window 37 in which is exposed a portion 36 of the slide 34 having a recess 38. This window 37 is only exposed when the door, drawer, or the like having the lock is opened. When exposed, the user of the lock can insert a pointed object in the hole 38 and displace the slide 34 between its positions as described in more detail below.

Figure 13:
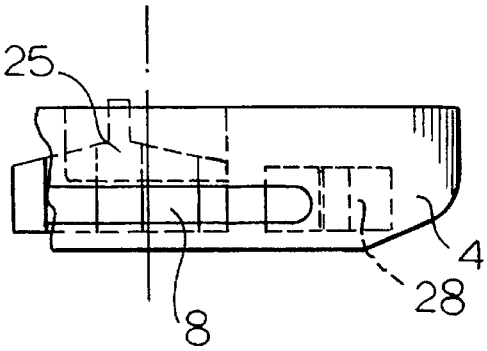
FIGS. 13 and 14 are top and side views of a portion of the lock.
Figure 14:
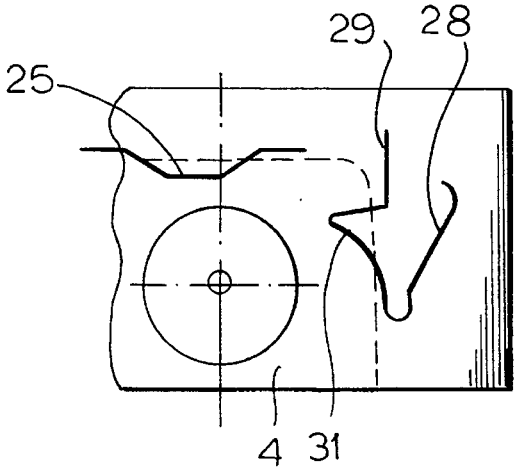

FIGS. 13 and 14 show how the housing 4 is provided with a retaining spring 25 having a blocking portion 24 that projects into the slot 8 and that engages a laterally projecting tab 23 of the latch plate 3. In the normal position of the spring 25 as shown in FIG. 2 this retaining spring 25 prevents movement of the plate 3 in the direction 20 from either of its end positions. Only when it is pushed back out of the slot 8 into a depressed position does the spring 25 free the plate 3 to move.

In addition an actuating spring 28 has an end 29 engaged in a slot 30 defined between two bent-down tabs 26 and 27 (FIG. 5) of the plate 3 and an actuation portion 31 extending into the slot 8 toward the rear of this slot 8. Normally this spring 28 does not bear on the plate 3 significantly. When as described below the portion 31 is pushed out of the slot 8, the spring 28 urges the plate 3 into the locked position, that is toward the right as seen in FIGS. 1 and 2. In addition when the plate 3 is in the locked position and the key 2 is not depressing the portion 31, the spring 28 urges the plate 3 into the unlocked position.

As seen in FIGS. 17 through 26, the key 2 has a body 39 (FIG. 25) formed by a pair of plastic side plates 42 and 43 sandwiching four key disks 40 each carrying a respective magnet 54. The upper plate 42 is formed with four circular throughgoing holes 44 that are stepped to have small-diameter outer portions 45 and large-diameter inner portions 46 defining shoulders 57. The lower plate 43 is formed with four cylindrical pockets or seats 48 of the same diameter as the large-diameter portions 46. The plates 42 and 43 are each formed at one end with a throughgoing hole 47 for a key chain or the like and both plates 42 and 43 are formed at one end with a cutout or notch 41 and with a projecting end 49 whose functions are described below.

Figure 25:
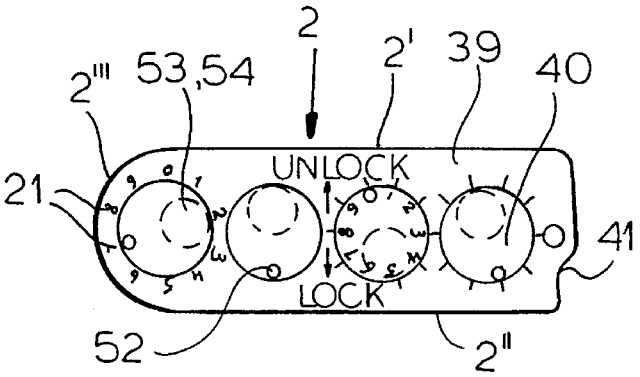
FIGS. 25 and 26 are top and side views of the complete key.
Figure 26:
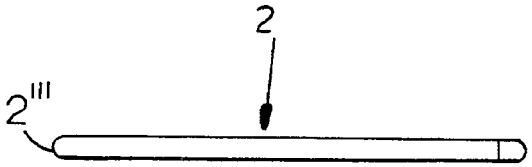
Figure 18:
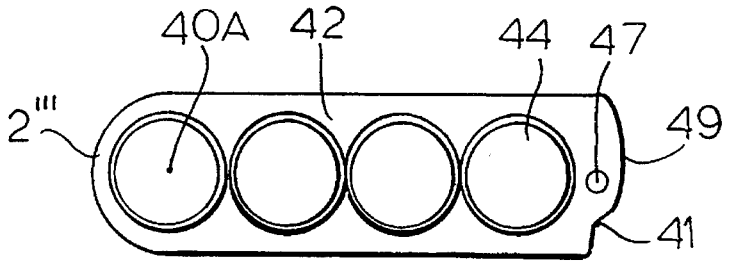
Figure 20:
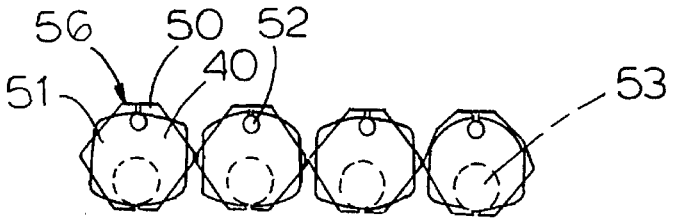
Figure 22:
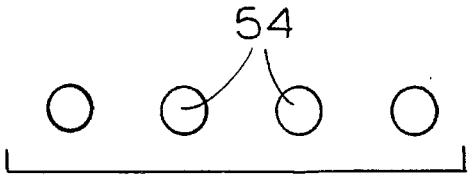
Figure 24:
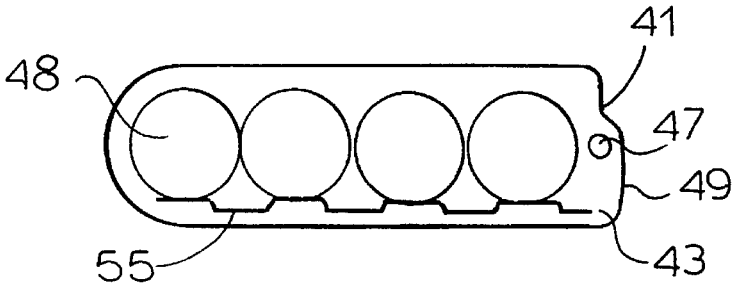

The key disks 40 each have a large-diameter lower portion 50 formed with flats or facets 56 and of the same diameter as the seats 48 and a smaller-diameter cylindrical upper portion 51 of the same diameter as the upper portions 45 of the holes 44. Thus the disks 40 can rotate in the key 2 about respective axes 40A with the large-diameter lower portions 50 captured between the shoulders 57 and the seats 48. A thin leaf spring 55 seated between the plates 42 and 43 bears radially inward on the flats 56 to hold the disks 40 against rotation unless they are torqued with sufficient force to deform the spring 55. The upper face of each disk 40 is formed diametrically opposite from a downwardly open hole 53 holding the respective magnet 54 with an upwardly open hole 52 that serves both for insertion of a tool used to rotate the disk 40 and to provide a reference point with respect to indicia 21 (FIG. 25) provided around each hole 44. The key 2 has one longitudinal edge 2' that is termed the unlock edge and an opposite edge 2" that is the lock edge, and the edges 2' and 2" are so marked as shown in FIG. 25.

Figure 29:
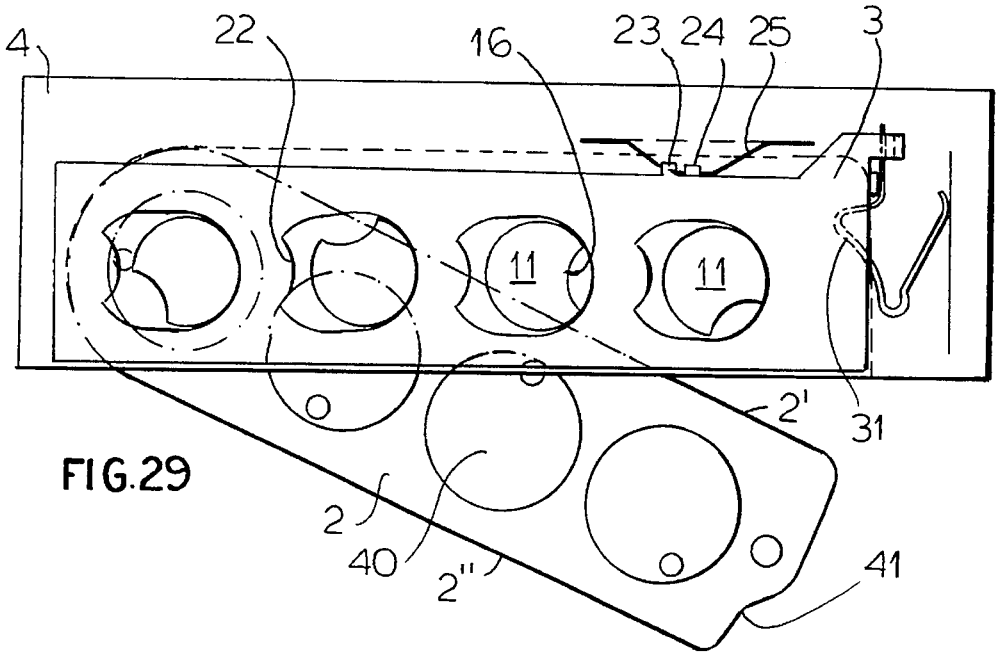
FIGS. 29 through 34 show the lock in various positions.
Figure 30:
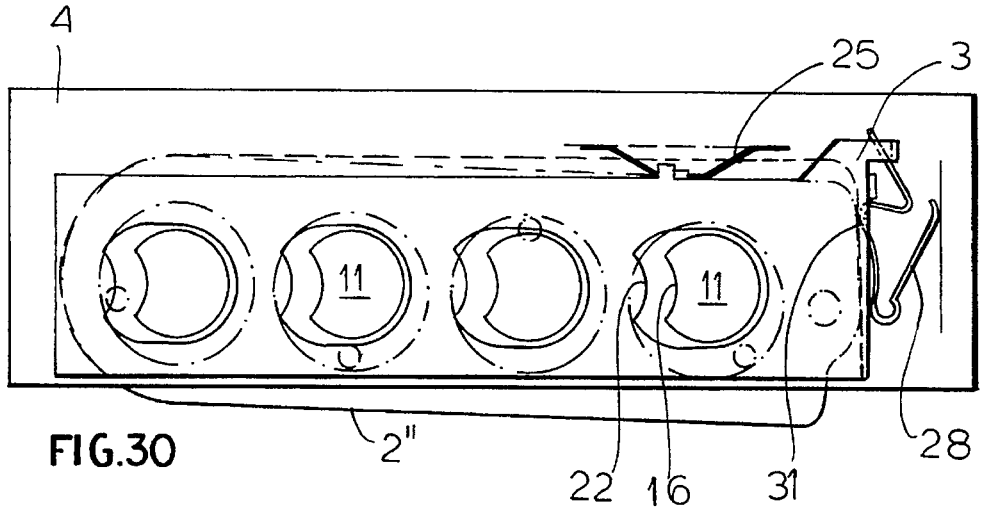

The lock assembly described above is operated as follows, presuming of course that the coding of the key and lock are the same:

With the plate 3 in the locked position as shown in FIG. 29, a rounded end 2'" of the key 2 is inserted into the slot 8 with the unlock edge 2' inward. Then the key 2 is pivoted inward as shown in FIG. 30. This engages the projecting part 49 with the actuation portion 31 of the spring 28 and pushes it out of the slot 8 so that the spring 28 is then biasing the plate 3 into the unlocked position. The plate 3 is, however, prevented from moving longitudinally by the retaining spring 25 and by the wheels 9 which are variously positioned with the notches 16 out of line with the bumps 22.

Figure 31:
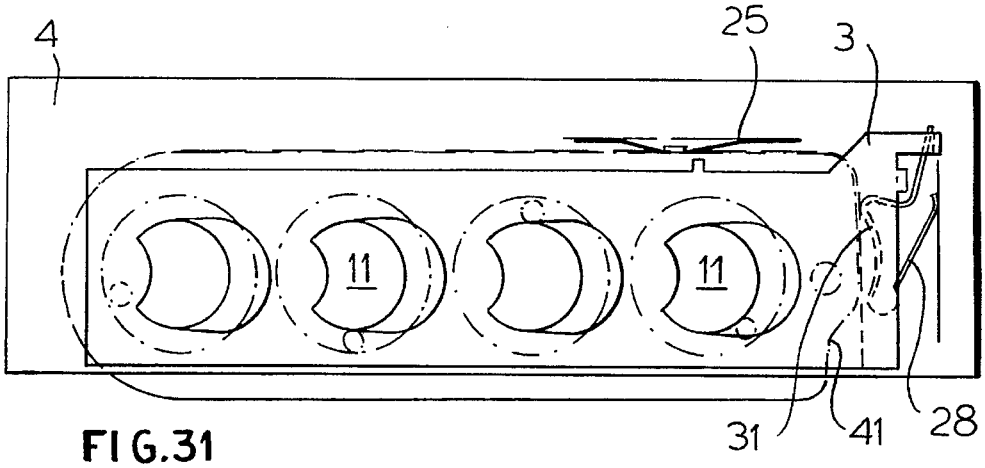

When the key 2 is pushed all the way into the slot as shown in FIG. 31, its magnet disks 40 align with the wheels 9 and the magnets 54 and 33 cause the wheels 9 to rotate into position with the cutouts 16 aligned with the bumps 22. In addition in this fully inserted position the unlock edge 2' engages the spring 25 and pushes it inward out of the slot 8. This frees the plate 3 to move into the unlocked position under the force of the spring 28. In this fully inserted position of the key 2, its lock edge 2" still projects from the housing 4 and, in fact, if the key 2 is released the spring 25 will push it out of the slot 8.

This action therefore unlocks the lock. The key 2 can be taken out of the slot 8, leaving the lock locked, since the spring 25 will hold the plate 3 in the locked position, even though the spring 28 in this position is biasing the plate 3 back into the unlocked position.

Figure 32:
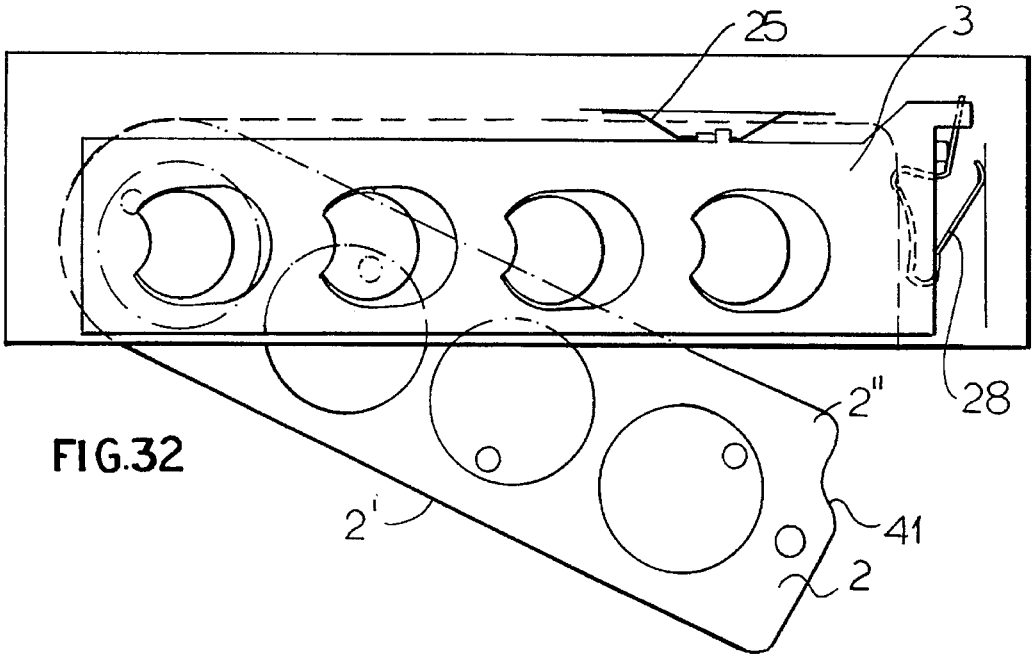
Figure 33:
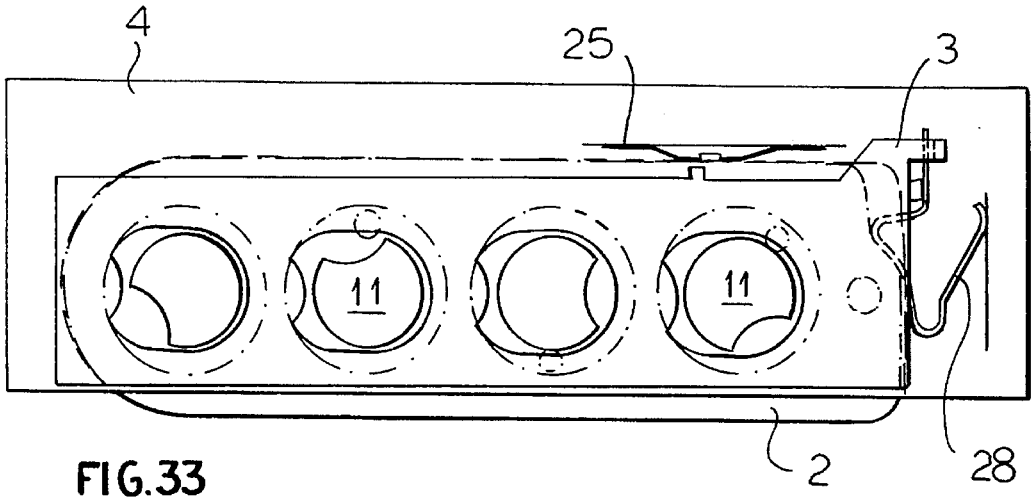
Figure 34:
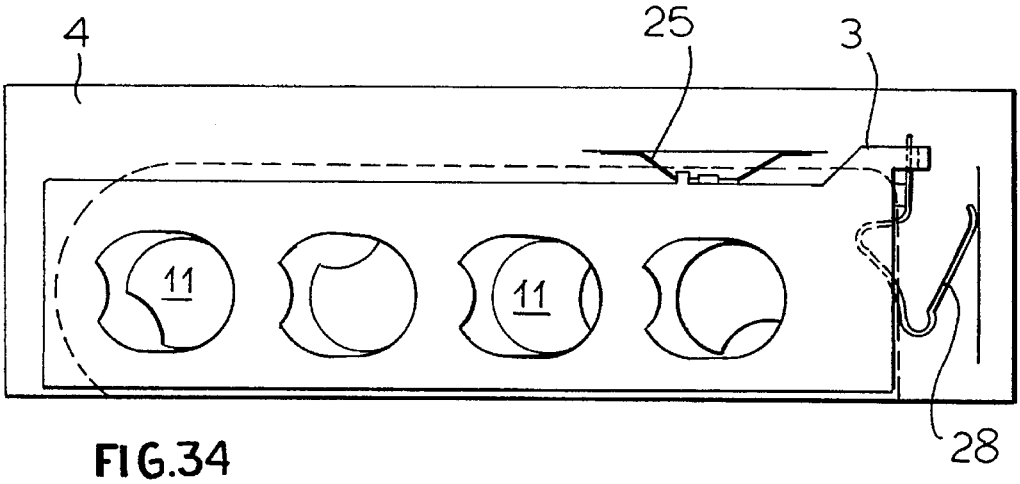
Figure 37:
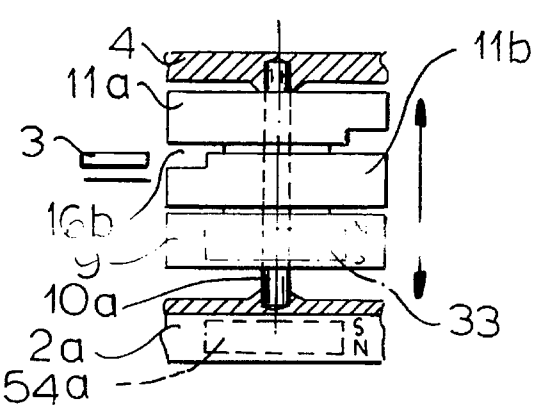
FIGS. 37 and 38 are views like FIGS. 35 and 36 but with the assembly actuated by a master key.
Figure 38:
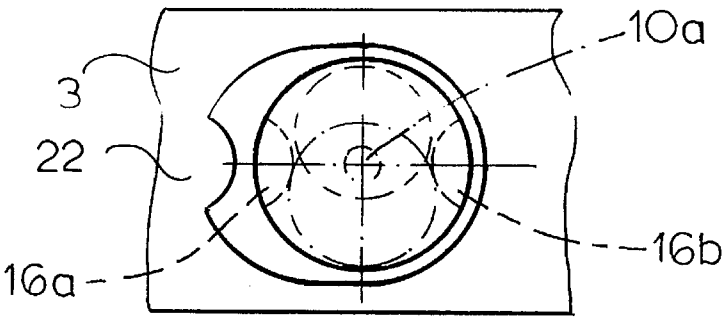
Figure 35:
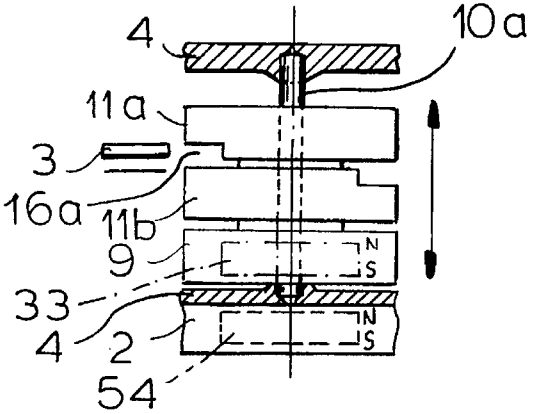
FIGS. 35 and 36 are sectional side and top views of the disk assembly of an alternative lock according to the invention in the normal position.
Figure 36:
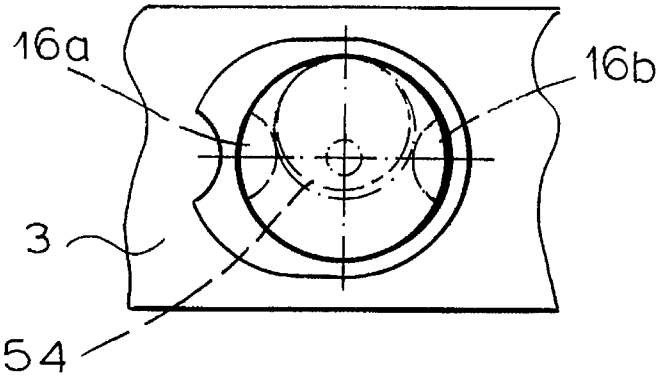

To lock the unlocked lock, the key 2 is turned around and is inserted into the slot 8 with its lock edge 2" inward as shown in FIG. 32. As it is moved fully inward into the position of FIG. 33, it will push in the spring 25 to release the plate 3 so that the spring 28 will drive it back to the locked position. Then its magnets 54 will scramble the setting of the wheels 11. When the key 2 is subsequently removed as shown in FIG. 34, the combination is left scrambled and the spring 25 is back in the retaining position to further prevent movement of the plate 3.

The coding of the lock is set as follows:

The lock and key are delivered to the end user set for a standard code, typically 0-0-0-0. The user then unlocks the lock as described above and uses an unillustrated stylus in the hole 38 (FIGS. 27 and 28) to set the reset slide 34 in the reset position decoupling the wheels 9 from the wheels 11.

Then the end user of the lock inserts the stylus into the holes 52 of the disks 40 of the key 2 and rotates each disk 40 to a position with the hole 52 aligned with one of the numbers of the indicia 21. Normally an easy-to-recall number, like the user's telephone number, is entered.

The key 2 is then inserted into the slot, unlock edge 2' first, as described above and shown in FIGS. 29–31. This will cause the wheels 9, which are freely rotatable and not coupled to the coupling wheels 11, to rotate into alignment with the disks 40. The slide 34 is then moved back into the normal position to couple each magnet wheel 9 with its respective coupling wheel 11, and the key 2 is removed. The new combination has been set.

FIGS. 35 through 38 show an arrangement that allows two keys 2 and **2*a* with different combinations to be used. To this end two rotationally coupled disks 11*a* and 11*b* are used with angularly differently oriented cutouts 16*a* and 16*b*. The disks 11*a* and 11*b* are axially shiftable on the respective axle 10*a* between a lower position (FIG. 35) with the cutout 16*a* alignable with the plate 3 and an upper position (FIG. 37) with the other cutout 16*b* aligned with it. The lower disk 11*b* carries the magnet 33**.

According to this arrangement the key 2 has its magnets 54 set to attract the magnets 33 and, therefore, align the cutouts **16*a* with the plate 3. Of course as in the above-described embodiment the magnets 33 and 54 work together to angularly position the double disk 11*a*, 11*b*. The magnets 54*a* of the master key 2*a*, however, are oppositely polarized so that they will at the same time raise the disks 11*a* and 11*b* axially and cause them to move angularly into positions with their magnets 33 diametrically opposite the magnets 54*a*. In this raised and 180° offset position the other cutout 16*b* is aligned with the plate 3** and the lock can open.

With this arrangement, therefore, two differently coded keys can be used to operate the same lock. The master key **2*a*** can be kept by the manufacturer for emergency purposes.

I claim:

1. A magnetically coded lock assembly comprising:

a lock having a housing formed with a key slot;

a latch element movable in the housing between a locked and an unlocked position; and at least one magnet wheel in the housing rotatable adjacent the slot about a wheel axis, provided with a magnet, operatively engageable with the latch element, and displaceable between a blocking position preventing the latch element from moving from the locked to the unlocked position and a freeing position not blocking such movement of the latch element; and a retaining spring in the lock housing engaging the latch element and movable between a blocking position projecting into the slot and preventing movement of the latch element from either of the respective positions and a depressed position not projecting into the slot and permitting movement of the latch element between the respective positions, and a key having a key body fittable in the slot, dimensioned to engage the retaining spring to depress the retaining spring into the depressed position on insertion of the key fully into slot, and formed with at least one seat;

a respective disk rotatable in the seat about a disk axis through a plurality of angularly offset positions, each disk being closely juxtaposed with a respective one of the wheels when the key body is fitted in the slot; and a magnet fixed in the disk.

2. The lock assembly defined in claim 1 wherein the key body is made of plastic and is formed with seats for the key disks.

3. The lock assembly defined in claim 1 wherein the key disks and wheels are rotatable about respective disk and wheel axes and the respective magnets are mounted eccentrically relative to the respective axes.

4. The lock assembly defined in claim 1 wherein each magnet wheel is rotatable about a respective axis and is provided with a coupling wheel also rotatable about the respective axis and engageable with the latch element, each magnet wheel and the respective coupling wheel having confronting faces one of which is formed with an annular array of recesses and the other of which is formed with at least one coupling projection engageable in the recesses in any of a plurality of relatively angularly offset positions of the respective magnet wheel and coupling wheel, the assembly further comprising means for axially separating the magnet wheels from the respective coupling wheels, whereby when the wheels are separated the relative angular positions which determine a coding of the lock can be changed.

5. The lock assembly defined in claim 4, further comprising a spring urging the coupling wheels toward the respective magnet wheels.

6. The lock assembly defined in claim 5 wherein the means for separating includes a slide in the lock housing having ramps engageable with the coupling wheels and displaceable between a normal position generally out of engagement with the coupling wheels and a reset position engaging the coupling wheels and lifting the coupling wheels off the respective magnet wheels.

7. The lock assembly defined in claim 1, further comprising spring means in the key body engaging the disks and resisting rotation of the disks in the key body.

8. A magnetically coded lock assembly comprising:

a lock having a housing formed with a key slot; a latch element movable in the housing between a locked and an unlocked position; and at least one magnet wheel in the housing rotatable adjacent the slot about a wheel axis, provided with a magnet, operatively engageable with the latch element, and displaceable between a blocking position preventing the latch element from moving from the locked to the unlocked position and a freeing position not blocking such movement of the latch element; and an actuating spring in the lock housing engaging the latch element and having an actuation portion displaceable between a projecting position projecting into the key slot with the actuating spring urging the latch element into the locked position and a depressed position not projecting into the slot with the actuating spring urging the latch element into the unlocked position and a key having a key body fittable in the slot and having generally parallel lock and unlock edges and an end bridging the edges and formed with a projection and a cutout, the key body being dimensioned such that when inserted fully into the slot with the unlock edge first the projection engages the actuation portion and displaces the actuation portion into the depressed position and when inserted fully into the slot with the lock edge first the notch engages over the actuation portion and leaves the actuation portion in the projecting position, the key body being formed with at least one seat;

a respective disk rotatable in the seat about a disk axis through a plurality of angularly offset positions, each disk being closely juxtaposed with a respective one of the wheels when the key body is fitted in the slot; and a magnet fixed in the disk.

9. A magnetically coded lock assembly comprising:

a lock having a housing formed with a key slot;

a latch element movable in the housing between a locked and an unlocked position; and at least one magnet wheel in the housing rotatable adjacent the slot about a wheel axis, provided with a magnet, operatively engageble with the latch element, and displaceable between a blocking position preventing the latch element from moving from the locked to the unlocked position and a freeing position not blocking such movement of the latch element, each wheel comprising a lower wheel carrying the magnet and formed with a lower cutout and an upper wheel rotationally and axially coupled to the lower wheel and formed with an upper cutout angularly off-set from the respective lower cutout, each upper and lower wheel being axially displaceable between a lower position with the upper cutout aligned with the latch member and an upper position with the lower cutout aligned with the latch member, the latch member being formed with bumps engageable in the respective cutouts aligned with the latch member in the freeing position of the wheels; and a key having a key body fittable in the slot and formed with at least one seat;

a respective disk rotatable in the seat about a disk axis through a plurality of angularly offset positions, each disk being closely juxtaposed with a respective one of the wheels when the key body is fitted in the slot; and a magnet fixed in the disk.

10. The lock assembly defined in claim 9 wherein the magnets of the key attract the magnets of the wheels and hold the magnets of the wheels in the lower position when the key is inserted into the slot.

11. The lock assembly defined in claim 10, further comprising a second key structurally similar to the first key but having oppositely polarized magnets that repulse the magnets of the wheels and hold the magnets of the wheels in the upper position when the second key is inserted into the slot.

* * * * *